United States Patent [19]

Mann

[11] Patent Number: 4,603,524

[45] Date of Patent: Aug. 5, 1986

[54] FIRE RESISTANT GLAZING SYSTEM

[75] Inventor: Robert Mann, Exeter, England

[73] Assignee: Lorient Polyproducts Ltd., Exeter, England

[21] Appl. No.: 634,416

[22] Filed: Jul. 25, 1984

[30] Foreign Application Priority Data

Jul. 28, 1983 [GB] United Kingdom ..... 8320324

[51] Int. Cl.[4] ..... E06B 1/04; E04C 2/54; E04F 19/02

[52] U.S. Cl. ..... 52/232; 52/207; 52/716

[58] Field of Search ..... 52/232, 207, 716, 204; 49/475, 504, 505

[56] References Cited

U.S. PATENT DOCUMENTS

| | | | |
|---|---|---|---|
| 1,147,836 | 7/1915 | Allmand | 49/475 |
| 2,453,528 | 11/1948 | Merryweather | 49/505 |
| 3,919,023 | 11/1975 | Bowser et al. | 52/232 |
| 3,981,118 | 9/1976 | Johnson et al. | 52/716 |
| 4,096,665 | 6/1978 | Ellingson, Jr. | 49/475 |
| 4,144,688 | 3/1979 | Dixon | 52/232 |
| 4,203,264 | 5/1980 | Kiefer et al. | 52/232 |
| 4,246,304 | 1/1981 | Dixon | 52/232 |
| 4,299,060 | 11/1981 | Tippmann | 49/505 |
| 4,477,507 | 10/1984 | Kunert | 52/716 |

FOREIGN PATENT DOCUMENTS

| | | | |
|---|---|---|---|
| 3102859 | 8/1982 | Fed. Rep. of Germany | 52/204 |

*Primary Examiner*—Carl D. Friedman
*Assistant Examiner*—Michael Safavi
*Attorney, Agent, or Firm*—Paul & Paul

[57] ABSTRACT

A glazing strip for mounting a pane, the strip including an extrusion of U-shape cross-section to define a channel for receiving a marginal edge portion of the pane to be mounted, the extrusion being hollow to define a U-shaped void in which is housed intumescent material.

9 Claims, 1 Drawing Figure

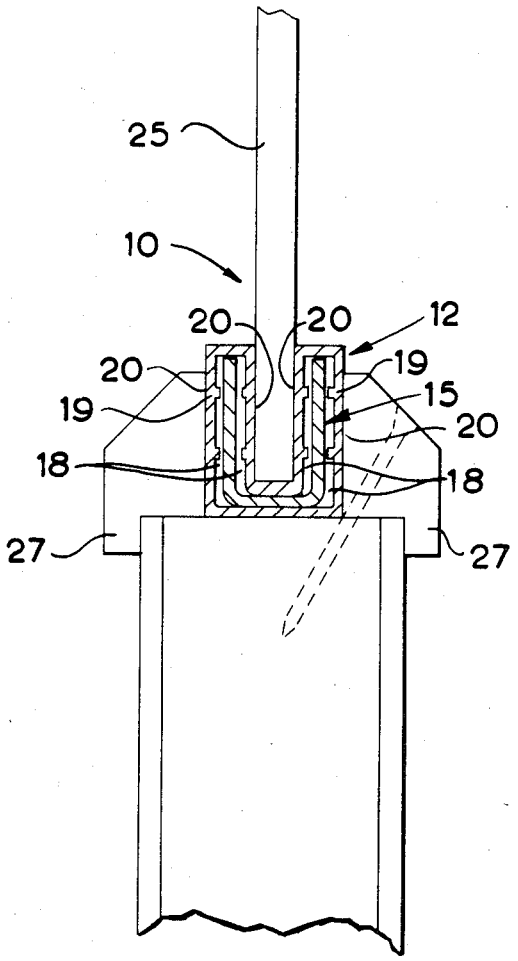
25
10
20
20
12
20
19
19
15
20
18
18
27
27

FIRE RESISTANT GLAZING SYSTEM

The present invention relates to a glazing system, in particular a glazing system which maintains its integrity under fire conditions. The invention also relates to a glazing extrusion for mounting a pane of glass.

In the glazing of buildings, in particular internal glazing, it is recognised that a serious fire risk exists in any location where glazed apertures are present since in the event of fire the glass quickly softens and falls from its aperture. In public buildings within the United Kingdom, such as hospitals, there is a Fire Authority requirement for glazed apertures to remain intact for at least 60 minutes.

Various proposals have been made to provide a suitable glazed aperture but these are either complicated in construction and thereby difficult to install and /or are not aesthetically pleasing and/or do not perform satisfactorily up to 60 minutes. For instance it has been proposed to provide a wire reinforced glass pane and mechanically secure the wire to the aperture surround so that after softening of the pane of glass the wire supports the softened pane in position.

A second type of system proposed is to locate the peripheral edge of the pane in a rigid non combustible material based on calcium silicate which in turn is mounted in the aperture. After softening of the glass the pane is unsupported and drops out.

Various aspects of the present invention are hereinafter described with reference to the sole accompanying drawing which is a schematic cross-sectional illustration through part of a glazing system according to the present invention.

The glazing system 10 includes a 'U' shaped extrusion 12 which defines a channel. The extrusion is preferably formed from rigid unplasticized P.V.C. The extrusion 12 is hollow to define a U-shaped void and houses an elongate strip 15 of intumescent material preferably PALUSOL (Registered Trade Mark). The strip 15 is generally U-shaped in cross-section.

The internal dimensions of extrusion 12 are such that a cavity 18 is provided between the intumescent material and the internal walls of the extrusion. Internal ribs 19 may be provided as shown to locate the intumescent material and also provide resistance to inward collapse of the walls 20 of the extrusion 12.

In use, lengths of the extrusion 12 are fitted about a pane of reinforced glass 25 and the thus framed pane of glass is inserted into the aperture to be glazed. Lengths of hardwood beading 27 are used to secure the framed pane of glass in position, the upper portion of the extrusion preferably protruding slightly above the upper edge of the beading 27.

The channel defined by the extrusion preferably has inclined walls so that the mouth of the channel is narrower than the base. In this way the extrusion positively grips the pane and avoids the need to use conventional glazing sealants. This is particularly advantageous when the pane is formed from wire reinforced glass which tends to be of varying thickness and normally requires the use of a specialised fire resistant glazing sealant in order to provide an adequate seal.

The purpose of the present invention is basically to provide insulation to the glass contained within the extrusion and thereby enable it to remain relatively rigid whilst the remainder of the pane is softened during a fire. The insulation is provided by virtue of the intumescent material intumescing and filling the cavity 18. The dimensions of the cavity 18 remain relatively stable during intumescence since the pane on the one hand and the beading 27 on the other hand resist outward deformation of the walls of the extrusion as would otherwise be caused by the internal pressure created during intumescence. The pressure of intumescence does in fact supplement the grip of the extrusion onto the pane. This is more important in the upper regions of the pane where the softened pane is suspended from the extrusion.

After the intumescence the extrusion is filled with a foamed residue which shields the glass from heat conduction even for a period after the hardwood beading has been ignited.

By protruding the upper portion of the extrusion above the beading 27, that portion serves to protect the beading on the opposite side of the pane to the fire from radiant heat and thereby delays igniton of that bead.

Preferably the intumescent strip 15 is produced by a thermo forming operation so that the U-shaped strip is continuous in cross-section. This ensures integrity of the intumescent material (and the insulation provided thereby) after intumescence which is particularly important in preventing the expanded intumescent material falling away from the upper regions of the pane following destruction of the extrusion 12. Additionally, it is envisaged that the intumescent material be reinforced with a soft wire to form a mechanical reinforcement to help maintain integrity of the intumescent material after expansion.

Accordingly by adopting an extrusion according to the present invention it is possible to provide a glazing system which retains integrity of a glazed aperture for a period of at least 60 minutes and yet enables hardwood beadings to be used in an aesthetically pleasing manner. In fact tests conducted to British Standard BS 476 part 8 have established that integrity is maintained well in excess of 60 minutes.

It will be appreciated that the dimensions of the extrusion 12 and strip 15 are chosen bearing in mind the degree of insulation required.

I claim:

1. A glazing strip for mounting a pane, the strip including an extrusion of U-shape cross-section to define a channel for receiving a marginal edge portion of the pane to be mounted, the extrusion being hollow to define a U-shaped void in which is housed intumescent material, the intumescent material being in the form of a U-shaped strip which partially fills the void to define a cavity between the intumescent strip and the internal side walls of the extrusion.

2. A glazing strip according to claim 1 wherein the internal side walls of the extrusion are provided with ribs for engaging the intumescent strip to space the strip from the said internal side walls.

3. A glazing strip according to claim 1 or 2 wherein the extrusion is shaped so that the mouth of the channel is narrower than the base of the channel.

4. A glazing strip according to claim 1 or 2 wherein the intumescent strip is reinforced with wire.

5. A glazing strip according to claim 1 or 2 wherein the extrusion is extruded from polyvinyl chloride.

6. A glazing system comprising in combination, a pane, and extending along each side edge of the pane a glazing strip and a pair of hardwood strips, the glazing strips including an extrusion of U-shape cross-section to define a channel for receiving a marginal edge portion of the pane to be mounted, the extrusion being hollow to define a U-shaped void in which is housed intumescent material, the intumescent material being in the form of a U-shaped strip which partially fills the void to define a cavity between the intumescent strip and the internal side walls of the extrusion, the glazing strip being mounted on the pane with the side edge received in the channel defined by the extrusion, and the hardwood strips being located on opposite sides of the extrusion to sandwich the extrusion therebetween, the hardwood strips being secured to the surround of an aperture into which the pane is to be mounted.

7. The combination according to claim 6 wherein the height of the extrusion is greater than the height of the hardwood strips such that when sandwiched between the hardwood strips the extrusion projects inwardly of the pane beyond the hardwood strips.

8. The combination according to claim 6 or 7 wherein the internal side walls of the extrusion are provided with ribs for engaging the intumescent strip to space the strip from the said internal side walls.

9. The combination according to claim 6 or 7 wherein the intumescent material is reinforced with wire.

* * * * *